United States Patent [19]

Valentin et al.

[11] 4,401,862

[45] Aug. 30, 1983

[54] ELECTRICAL SWITCH WITH SLIDING CONTACTS

[76] Inventors: Bernard Valentin, Max-Planck-Strasse 14a, D-8900 Augsburg 21; Ernst Heinl, Birkenweg 30, D-8051 Unterzolling, both of Fed. Rep. of Germany

[21] Appl. No.: 268,465

[22] Filed: May 29, 1981

[51] Int. Cl.[3] ..... H01H 1/12; H01H 19/02; H01H 21/02; H01H 15/02

[52] U.S. Cl. ..... 200/11 K; 200/16 D; 200/238; 200/252

[58] Field of Search ..... 200/11 R, 11 G, 11 J, 200/11 HK, 16 R, 16 C, 16 D, 237, 238–242, 252, 272, 275, 279, 285, 292

[56] References Cited

U.S. PATENT DOCUMENTS

| | | | |
|---|---|---|---|
| 2,755,347 | 7/1956 | Allison | 200/11 D |
| 2,843,709 | 7/1958 | Kreisinger | 200/275 |
| 3,024,334 | 3/1962 | Rhodes | 200/11 K |
| 3,187,119 | 6/1965 | Dyksterhouse | 200/16 C |
| 3,431,374 | 3/1969 | Raab | 200/16 CX |
| 3,499,126 | 3/1970 | Jones et al. | 200/16 R |
| 3,624,320 | 11/1971 | Eberhart | 200/16 D |
| 3,689,714 | 9/1972 | Walz | 200/16 D X |

FOREIGN PATENT DOCUMENTS

| | | |
|---|---|---|
| 598540 | 6/1934 | Fed. Rep. of Germany . |
| 2017348 | 10/1970 | Fed. Rep. of Germany . |
| 2260019 | 6/1974 | Fed. Rep. of Germany . |
| 2458843 | 6/1976 | Fed. Rep. of Germany . |
| 488194 | 12/1979 | Fed. Rep. of Germany . |
| 2013569 | 4/1970 | France . |
| 215758 | 10/1941 | Switzerland . |
| 1194970 | 6/1970 | United Kingdom . |
| 1203053 | 8/1970 | United Kingdom . |

*Primary Examiner*—J. R. Scott
*Attorney, Agent, or Firm*—Clyde C. Blinn

[57] ABSTRACT

In an electrical switch being subject to high contact pressure and using contacts of relatively soft contact material, the isolating or electrical resistance is impaired by contact wear. A contact and a counter contact spring supported by an isolating support before and/or behind the contact with an area the surface of which is located lower than the level of the topside of the contact. On at least one side of said recess area, the isolating support is provided with an elevated portion which also extends in the direction of relative movement of the contact spring and on which the contact spring rests when the switch is in its open position.

10 Claims, 11 Drawing Figures

FIG. 4A
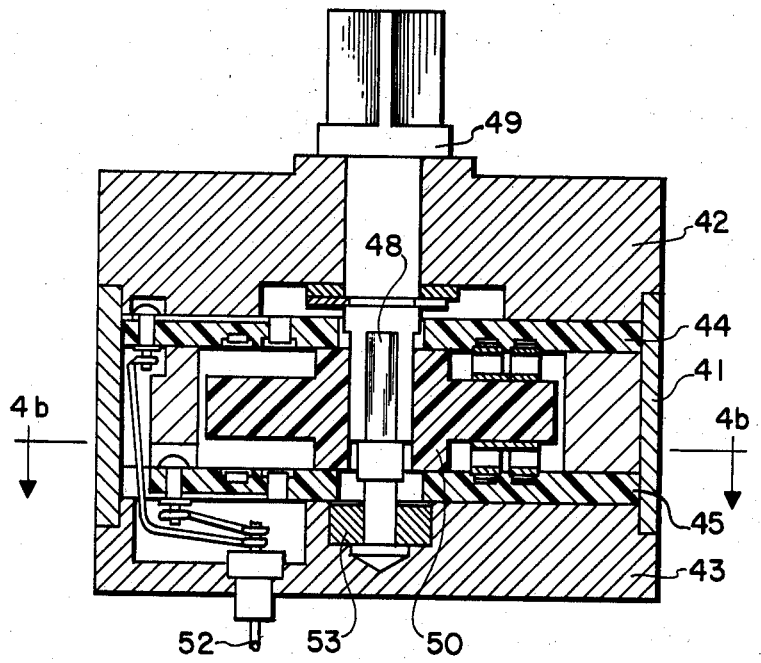
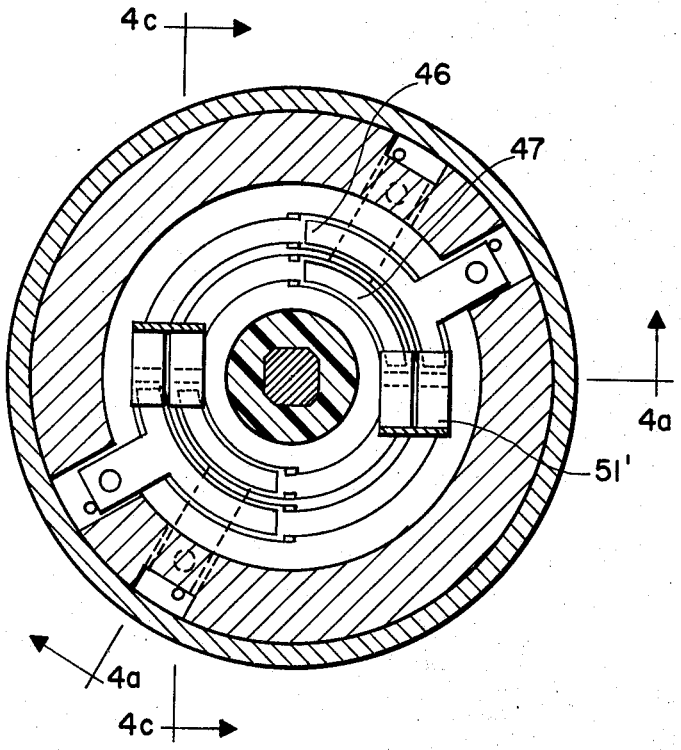
FIG. 4B
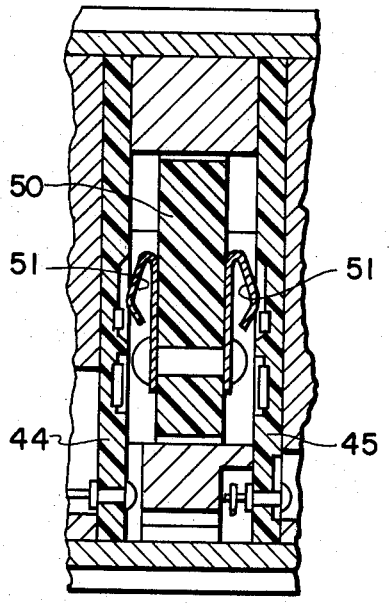
FIG. 4C

ELECTRICAL SWITCH WITH SLIDING CONTACTS

BACKGROUND AND SUMMARY OF THE INVENTION

The invention relates to electrical switches and, in particular, to switches having at least one stationary contact made of highly conductive material preferably nobel metal being supported by an electrically isolating support and furthermore comprising at least one counter contact spring for operating with said stationary contact and being arranged such that this contact spring rests on the isolating support when the electrical switch is in its open position.

If it is desired to switch low voltages and a small current and to achieve a very small contact or transition resistance in the closed position of the switch the engaging contact surfaces have to be made of a material that conducts well. If it is required that the low transition resistance even for a long time is not increased by oxidation or other impairing effects on the surface properties of the contact material in practice only nobel metals such as gold can be used as contact material. Gold, however, is a relatively soft material so that with such contacts a removal by scratching or wearing of contact material may arise, particularly if the contact springs engage each other under strong tension. This in many cases is required if the switch is required to be vibration and shockproof. If, in the course of operating the switch, contact material is removed by the contact spring and is deposited on adjacent parts of the support, the isolating resistance of the switch is decreased in an uncontrolled manner. This, in particular, when small currents and low voltages have to be switched, leads to interference and falsification of signals.

It is an object of the invention therefore to provide a switch of the kind as stated above in which, in spite of using relatively soft contact material, and in spite of relatively high contact pressure being applied, any reduction of isolating resistance caused by wearing away of contact material is safely avoided. These and other objects are solved by the invention as characterized in the appending claims. By providing the isolating support with a recessed portion behind the contact, eventual contact wear will be collected within said recess portion or pocket. Since with the switch in the open position the contact spring does not rest on the recessed portion of the isolating support but on elevation portions extending in parallel to the pocket and since no contact wear can be moved to said elevated portion, the high isolating resistance between the stationary and the counter contact spring will not be impaired by eventual deposits of metal due to contact wear. The switch is characterized by a relatively simple structure and a high long-term reliability.

DESCRIPTION OF THE DRAWINGS

FIG. 1 shows in different views and sections in an increased scale the structure of the essential parts of a switch comprising an isolating support carrying a stationary contact which cooperates with a counter contact in the form of a wire spring;

FIGS. 4*a*–4*c* illustrate a rotary switch in which two contact supports are provided stationarily apart from each other and where a support carrying contact spring is fixed to the rotary shaft of the switch.

DESCRIPTION OF THE INVENTION

Figure 1A:
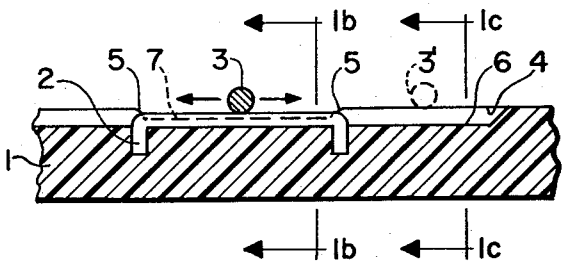
FIG. 1*a* is a sectional view along line Ia—Ia of FIG. 1*b*.
Figure 1C:
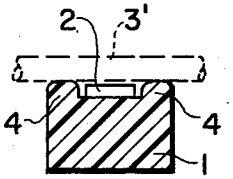
FIGS. 1*b* and 1*c* are sectional views along lines Ib—Ib and Ic—Ic, respectively, of FIG. 1*a;*
Figure 1B:
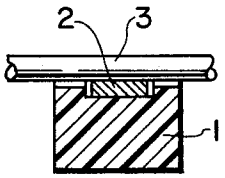
Figure 1D:
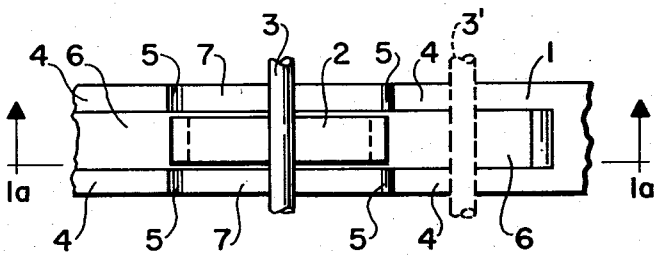
FIG. 1*d* is a top view of FIG. 1*a;*

Reference now is made to the embodiment of FIG. 1. FIG. 1*a* shows the isolating support 1 in a sectional view and FIG. 1*d* when seen from above. The isolating support consists, for instance, of polyamide or a glass fiber reinforced synthetic material. Inserted into the upper surface of the isolating support 1, preferably pressed into this surface, is a bow-shaped flat contact or member 2 which cooperates with a counter contact spring or member 3 shown only partially. Either the isolating support 1 is stationarily mounted and the counter spring 3 is movable in the direction of the arrows, or vice versa. In the shown switching position according to FIGS. 1*a* and 1*b*, the counter contact spring 3 rests on contact 2, that is, the switch is in its closed position. If the contact spring 3 is moved into the position as shown dotted in FIGS. 1*a*, 1*c*, and 1*d*, the switch is in its open position. The contact spring 3' now no longer engages contact 2 but now rests on longitudinal insulation support members or projections 4 of the isolating support 1 which extend in parallel to the relative movement of the contacts. Inclined surfaces 5 achieve an easy sliding transition of counter contact 3 from the surface of contact 2 to the projection 4 which is slightly higher than the surface of contact 2. If in the course of this movement contact spring 3 should wear some particles of contact material from the surface of contact 2, these particles will be moved and collected in the pocket 6 of the isolating support which is slightly reset with respect to the surface contact 2 and therefore lies deeper than the surface of projection 4. The width of this pocket corresponds about to the width of contact 2. The contact material therefore will not be moved to the projections 4 of the isolating support 1 on which the contact spring 3' rests in the open position of the switch. Therefore the isolating resistance will not be impaired by wear of particles of contact material during operation of the switch. In the area aside contact 2 the surface 7 of the isolating support 1 is lowered somewhat below the surface level of contact 2 so that in this area contact spring 3 rests on contact 2. It is sufficient if departing from the showing of FIGS. 1 and 2 a projection 4 is provided only at one side of contact 2.

Figure 2A:
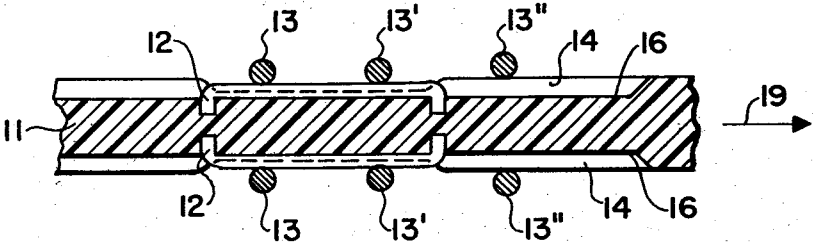
FIGS. 2*a* and 2*b* show, in the manner of FIGS. 1*a* and 1*b*, a switch having an isolating support which is provided on both sides with stationary contacts for operating with a counter contact in the form of a hairpin.
Figure 2B:
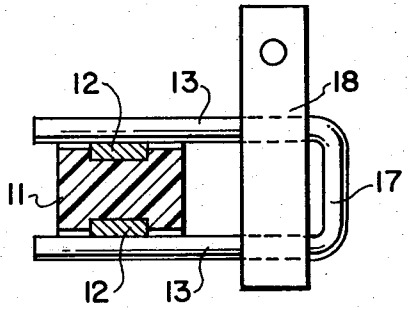

FIG. 2 schematically shows a double-throw switch with contacts 12 being provided at both sides of isolating support 11. These movable contacts 12 cooperate with stationary contact pairs 13, 13' and 13''. The two contact springs of each pair are formed by the legs of a single contact spring 17 formed like a hairpin which is supported in a metal terminal block 18. This embodiment with double contacts, in particular, is suited for switches which are subject to vibration or shock. If, due to acceleration or vibration, the contact force of the one leg of the spring contact should be reduced, the contact pressure at the opposite contact spring will be increased simultaneously so that a safe electrical connection is guaranteed.

In the switch position as shown in FIG. 2*a* contact 12 connects contact pairs 13 and 13'. If the isolating support 11 is moved in the direction of arrow 19 this connection is interrupted and instead of this a connection is provided between contact spring pairs 13' and 13''. Again the contact spring legs 13' which do not rest on contacts 12 are supported by lateral projections 14 extending in parallel to the relative movement of the contacts. Between these projections 14 a pocket 16 is provided for collecting any particles of contact wear.

Figure 3A:
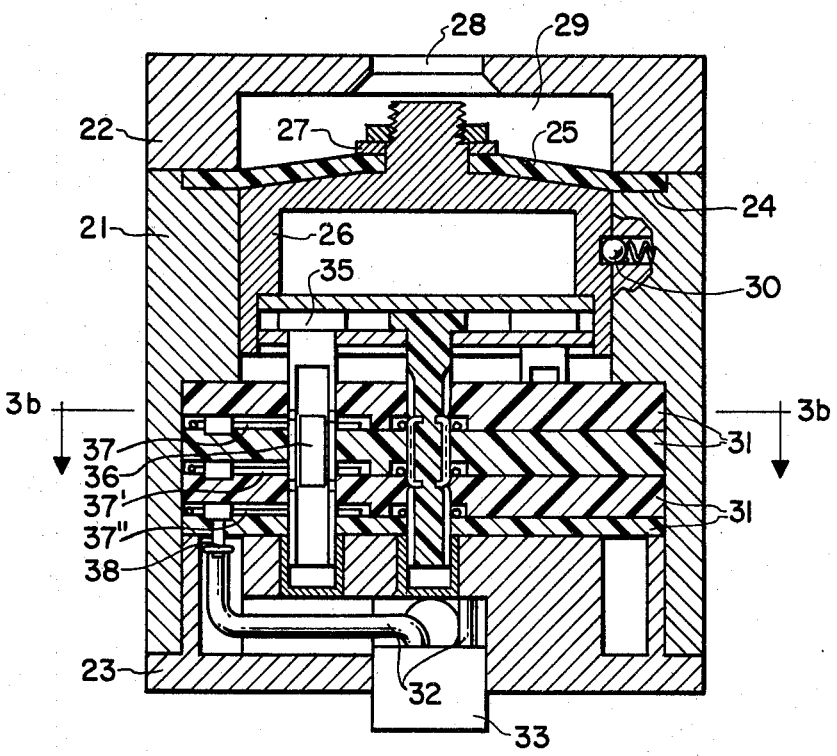
FIG. 3 shows a pressure operated multiple switch with stationary contact springs and a movable isolating support for the non-resilient counter contacts.

FIG. 3 shows the application of such a shockproof movable contact switch as pressure operated multiple switch. In a cylindrical housing consisting of a hollow cylindrical central portion 21, a cover 22 and a bottom portion 23, a ring diaphragm 25 is clamped between a collar 24 of the central portion 21 and the cover 22. This diaphragm 25 engages a cup-shaped contact carrier 26. A diaphragm plate 27 clamps the internal edge of diaphragm 25 to the contact carrier 26. If, through an inlet opening 28, a pressure medium such as air or water is supplied into chamber 29, this pressure moves cup-shaped contact carrier 26 downwards as soon as the holding force of ball barrier 30 is exceeded. In the shown resting position, movable contact 36 provides an electrical connection between contact springs 37 and 37'. If, however, contact carrier 26 is moved under the influence of the pressure as mentioned above, this electrical connection between contact springs 37 and 37' is removed and an electrical connection between contact spring pairs 37' and 37'' is achieved via contact 36. Also in this case the individual contact springs are double springs shaped like hairpins and are supported in a metal terminal piece 38 which, by means of isolating discs 31, is fixed to the switch housing. Isolated wires 32 connect the individual terminal contacts 38 to a cable connector 33.

Figure 3B:
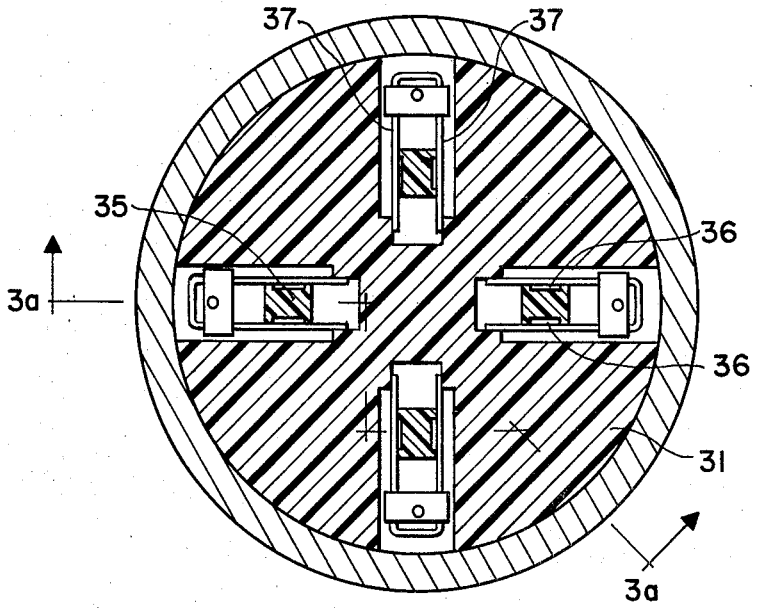

As FIG. 3*b* shows, several switches of this kind are distributed around the circumference of the housing. Each of these switches may operate as a normally open contact, a normally closed contact, or a switch-over contact, or double-throw switch. All contacts are simultaneously switched by means of a common contact carrier which carries the isolating supports 35 having the form of rectangular pins.

FIG. 4 shows an embodiment of a rotary switch constructed in accordance with the present invention. Again a hollow cylindrical central portion 41, a cover 42 and a bottom portion 43 together form a housing. Two contact supports 44 and 45 are positioned apart from each other stationarily within said housing and have the form of two flat rings. The structure of contact 46 and 47 can be seen from FIG. 4*b*. On a rectangularly profiled portion 48 of the switch shaft 49 a contact carrier 50 is fixed such that it cannot be turned with respect to the switch shaft 49 and is located between the two isolating supports 44 and 45. This contact support 50 carries the bow-shaped counter contact springs 51. In the closed position of the switch these spring contacts 51 perform an electrical connection between the stationary contacts 46 and 47 which are connected to an electrical device which has to be switched via a cable 52. The rotary shaft 49 of the switch is borne at one side in the cover 42 and on the other side within a bearing sleeve 53 of the bottom portion 43 of the housing.

Also in this case, in accordance with the principle as explained in connection with FIG. 1, it is desired that eventual contact wear will not reduce the isolating resistance of the switch in the circuit position. This is achieved by the contact and its adjacent pocket portion of the isolating supports as well as by the supporting surfaces of the isolating supports 44 and 45 of FIG. 4*a* on which the contacts rest when the switch is in its open position.

What is claimed is:

1. Electrical switch comprising at least two contacts made of highly conductive material, preferably made of noble metal, which are carried on opposite sides of an isolating support of high electrical resistance material and cooperate with a counter contact spring which in the open position of the switch rests on opposite sides of said isolating support, wherein:

seen in the direction of relative movement between said contacts and said contact spring, said isolating support is provided before and/or behind said contact with an area the surface of which is located lower than the level of the top side of said contacts;

the width of said lowered or recessed area corresponds to the width of said contacts;

on at least one side of said recess area, said isolating support has a portion which also extends in the direction of relative movement and the surface of which is situated not lower than the level of the top side of the contact; and in open position of the switch the counter contact spring rests on said portion.

2. The switch according to claim 1, wherein that said portion of the isolating support extending in parallel to said recess area is slightly elevated with respect to the level of the top side of the contact.

3. The switch according to claim 2, wherein between said contacts the surface of said isolating support is lowered below the level of the top side of said contacts.

4. The switch according to claim 1, wherein said counter contact spring is formed by the legs of a contact wire or contact plate formed like a hairpin.

5. The switch according to claim 1, wherein the contacts are provided at two isolating supports which are spaced apart; and between said supports a contact spring carrier is located having counter contact springs on both sides.

6. The switch according to claim 4, wherein, in the direction of relative movement, said counter contact spring and a second counter contact spring are spaced apart in series.

7. The switch according to claim 1, wherein the relative movement is a longitudinal movement.

8. The switch according to claim 1, wherein the relative movement is a rotary movement.

9. An electrical switch comprising at least two stationary contact members, said contact members mounted on opposite sides of said support, said support forming an insulation support member on each side of said contact members, and movable contact members engaging each of said stationary contact members and being slidable along the surface of each to provide an electrical connecting circuit, said movable contact member engaging said insulation support member and being slidable along said insulation support member on each side of each of said stationary contact members to provide an open electrical circuit, said insulation support member having a recess area between parallel sides of said support member beyond said stationary contact members for collecting material resulting from the engagement wear of said movable contact member engaging said stationary contact members.

10. The invention of claim 9 wherein one of said contact members is made of soft metal whereby upon said movable contact member sliding over said stationary contact member particles of said one contact member are collected in said recess and said movable contact member slides over said recess when engaging said insulation support member.

* * * * *